United States Patent [19]

Stoldt et al.

[11] Patent Number: 4,781,730

[45] Date of Patent: Nov. 1, 1988

[54] FUEL ADDITIVE COMPRISING A HYDROCARBON SOLUBLE ALKALI OR ALKALINE EARTH METAL COMPOUND AND A DEMULSIFIER

[75] Inventors: Stephen H. Stoldt, Concord Township; Scott T. Jolley; Reed H. Walsh, both of Mentor, all of Ohio

[73] Assignee: The Lubrizol Corporation, Wickliffe, Ohio

[21] Appl. No.: 58,456

[22] Filed: Jun. 5, 1987

[51] Int. Cl.[4] ..... C10L 1/22; C10L 1/30

[52] U.S. Cl. ..... 44/71; 44/70; 44/68

[58] Field of Search ..... 44/71, 70

[56] References Cited

U.S. PATENT DOCUMENTS

| | | | |
|---|---|---|---|
| 2,944,025 | 7/1960 | Verdal | 252/51.5 |
| 3,088,815 | 5/1963 | Haney | 44/71 |
| 3,183,070 | 5/1965 | Udelhofen | 44/71 |
| 3,362,906 | 1/1968 | Cyba | 44/71 |
| 3,429,673 | 2/1969 | Reese et al. | 44/71 |
| 3,658,707 | 4/1972 | Delafield et al. | 44/71 |
| 3,806,456 | 4/1974 | Vogel | 44/71 |
| 3,836,470 | 9/1974 | Miller | 44/70 |
| 3,838,050 | 9/1974 | Miller | 44/70 |
| 3,838,052 | 9/1974 | Miller | 44/70 |
| 3,955,938 | 5/1976 | Graham et al. | 44/51 |
| 3,957,854 | 5/1976 | Miller | 44/71 |
| 3,957,855 | 5/1976 | Miller | 44/71 |
| 4,659,338 | 4/1987 | Johnston et al. | 44/68 |

*Primary Examiner*—William R. Dixon, Jr.
*Assistant Examiner*—Jerry D. Johnson
*Attorney, Agent, or Firm*—Forrest L. Collins; Robert A. Franks; Roger Y. K. Hsu

[57] ABSTRACT

The compositions described herein of an alkali metal or alkaline earth metal containing composition with or without a hydrocarbon soluble dispersant which are combined with the reaction product of the carboxylic acid and a polyhydroxyalkanolamine. The resultant compositions are resistant to partition or separation when mixed with water.

32 Claims, No Drawings

FUEL ADDITIVE COMPRISING A HYDROCARBON SOLUBLE ALKALI OR ALKALINE EARTH METAL COMPOUND AND A DEMULSIFIER

BACKGROUND OF THE INVENTION

1. Field of the Invention

This invention deals with additives which are particularly useful in refinery operations for adding a alkali metal or alkaline earth metal containing compound to an unleaded gasoline for valve seat recession protection.

2. Description of the Art

It is known from Graham et al, U.S. Pat. No. 3,955,938 issued May 11, 1976 that automobile valve seats, particularly on older model cars, require protection to avoid excessive wear. The valve seat recession problem is particularly severe in vehicles which were designed to run on leaded fuels and which must now use unleaded fuels. Graham suggested the introduction of a sodium and phosphorus-containing compound to an unleaded gasoline to provide valve seat recession protection. In U.S. Pat. No. 4,659,338 issued Apr. 21, 1987, Johnston and Dorer, suggested that a low lead or no lead containing gasoline incorporate a hydrocarbon-soluble alkali or alkaline earth metal-containing composition and at least one hydrocarbon-soluble ashless dispersant.

It is observed that the over-based composition suggested by Graham is particularly susceptible to separation into water found in a refinery, a fuel storage tank or an automobile fuel tank. To some extent, the problem of leaching of the composition into an aqueous phase also exists with the neutral or slightly acid forms of the composition.

It has further been observed that the source of the alkali metal or alkaline earth metal containing composition and a hydrocarbon-soluble ashless dispersant may emulsify. That is, when a mixture of the alkali or alkaline earth metal, a hydrocarbon-soluble ashless dispersant and water are subjected to high shear an emulsion can occur. The emulsification is particularly deleterious when a fuel filter in a vehicle becomes plugged or that the emulsification results in the loss of the active species, e.g., the alkali metal or alkaline earth metal, which is then not delivered to the vehicle in the requisite amount. The emulsification problem is particularly evident under refinery conditions where substantial volumes of water are present due to processing and where high speed pumps are used to deliver the refined gasoline via a pipeline.

The present invention deals with a particular group of nitrogen-containing esters which are useful as demulsifiers or stabilizers of the product in the fuel phase, thus, minimizing the effect of shear. It may also be viewed in the present invention that the demulsifier aids in separating any emulsified active ingredient from the aqueous phase back to the fuel phase.

Various nitrogen-containing or ester compositions have been utilized in fuel or lubricant containing products. For instance, in U.S. Pat. No. 3,362,906, issued Jan. 9, 1968 to Cyba, it is disclosed that lubricants and hydrocarbon oils may be stabilized against deterioration by means of a reaction product of an alkanolamine with a polyhalopolyhydropolycyclicdicarboxylic acid or its anhydride or ester. It is also known from U.S. Pat. No. 3,088,815, issued May 7, 1963 to Haney that fuel degradation particles may be avoided by reacting approximately equal molar portions of a dibasic acid or its anhydride or ester with an alkyl substituted dialkanolamine.

In U.S. Pat. No. 3,183,070, issued May 11, 1965 to Udelhofen, it is suggested that hydroxy amine esters of succinic acid provide benefits against rust and corrosion in storage tanks, valves, pipelines, tank car walls, burners, gasoline tanks and crankcases. Delafield et al, in U.S. Pat. No. 3,658,707, issued Apr. 25, 1972, suggests that gasoline compositions may be improved through the use of a mixture (1) of carboxylic acids containing from 10 to 60 carbon atoms per molecule, or esters or anhydrides of such acids and (2) esters of alkoxylated phenol-aldehyde resins.

In U.S. Pat. No. 2,944,025, issued July 5, 1960 to Verdol, it is suggested that a hydrocarbon oil may be formed from a dibasic acid which is reacted with an alkyl substituted diethanolamine. The products of Verdol are stated to be particularly useful as low temperature dispersants in mineral oils of lubricating viscosity.

The present invention deals with a problem which has not been previously recognized in the art, namely, to incorporate an alkali metal or alkaline earth metal containing material for valve seat recession in a low lead or unleaded gasoline, and to ensure against substantial loss of the active ingredient through contact with water. The present invention solves the foregoing problem through the incorporation of a nitrogen containing ester which functions as a demulsifier.

Throughout the specification, percentages and ratios are by weight, temperatures are in degrees Celsius, and pressures are KPa gauge unless otherwise indicated. To the extent that the references cited herein are applicable to the present invention, they are incorporated by reference.

SUMMARY OF THE INVENTION

The present invention describes a composition comprising:

(a) a hydrocarbon soluble or dispersible alkali metal or alkaline earth metal containing composition, and (b) the reaction product of (i) a polybasic acid, and (ii) a polyhydroxyalkanolamine of the formula:

$$RN[(AO)_xH][(DO)_yH]$$

wherein R is a hydrocarbyl radical, A and D are the same or different alkylene groups and x and y are each at least 1.

A further aspect of the invention is a process for reducing valve seat recession in a vehicle requiring such protection comprising introducing to the fuel tank of the vehicle a composition comprising:

(a) a hydrocarbon soluble or dispersible alkali metal or alkaline earth metal containing composition, and (b) the reaction product of (i) a polybasic acid, and (ii) a polyhydroxyalkanolamine of the formula:

$$RN[(AO)_xH][(DO)_yH]$$

wherein R is a hydrocarbyl radical, A and D are the same or different alkylene groups and x and y are each at least 1.

DETAILED DESCRIPTION OF THE INVENTION

The first aspect of the present invention to be discussed is the polybasic acid. The polybasic acid may be either an acid or an anhydride, and is preferably a dicarboxylic acid. The use of disfunctional acids limits the amount of cross-linking which is possible in the reaction product with the polyhydroxyalkanolamine as is later discussed.

The polybasic acids are commercially available and are conveniently materials such as adipic, malic, diglycolic, or other relatively low molecular weight polycarboxylic acids.

Additional dibasic acids which may be utilized in the present invention are those preferably non-aromatic materials which are either straight or branched, saturated or unsaturated, and which contain from about 4 to about 60 carbon atoms, preferably from about 4 to about 40 carbon atoms.

A further preferential situation for the polycarboxylic acid is that it is an alpha-omega dicarboxylic acid. By alpha-omega dicarboxylic acid, it is meant that the molecule containing the carboxylic acid moieties contains them at opposite ends of the molecule. Thus, adipic acid and diglycolic acid are both examples of alpha-omega dicarboxylic acids.

The dimer acids (and the corresponding trimer acids) may be employed as the polybasic acid. The dimer acids, in particular, are described in *The Dimer Acids*, pages 4–17 edited by Edward C. Leonard, Humko-Sheffield Chemical, Memphis, Tenn.

The polyhydroxyalkanolamines particularly useful in the present invention are materials with the formula $$RN[(AO)_xH][(DO)_yH]$$

wherein R is a hydrocarbyl radical containing from about 4 to about 20 carbon atoms, A and D are an alkylene group and x and y are each 1. The polyhydroxyalkanolamines are also commercially available materials or may be readily formed from the reaction of the corresponding amine and an alkylene oxide. It is first noted that the alkylene groups are preferably ethylene or propylene. Mixtures of ethylene and propylene are also possible and are desired for special uses where the products may be formed by capping reactions, e.g., propylene oxide capped onto an ethylene oxide adduct of the amine.

For most purposes, it is desired that x and y are each 1 such that the material is the simplest of the species embodied by the formula given above. The value of R as a hydrocarbyl radical is preferably from about 1 to about 20 carbon atoms, more preferably from about 6 to about 18 carbon atoms and most preferably from about 12 to about 18 carbon atoms.

It is preferred that the sum of $x+y$ which shows the degree of alkoxylation of the polyhydroxyalkanolamine is from about 2 to about 60, preferably 2 to about 40.

The reaction product of the polybasic acid and the polyhydroxyalkanolamine may be by either of two general methods. That is, the resulting ester (reaction product) can be prepared by direct esterification of the polybasic acid or anhydride with the alkanolamine. It is also possible that a dibasic acid ester corresponding to the polycarboxylic acid may be prepared by an ester interchange between the acid ester and the alkanolamine. Such methods of preparing the reaction product of a polybasic acid and an polyhydroxyalkanolamine are well known in the art and, thus, are not further discussed at this point.

It is noted, however, that the preferable molar ratio for a dicarboxylic acid reacted with the polyhydroxy alkanolamine is typically from about 2:1 to about 1:2, preferably from about 3:2 to about 2:3. The materials which contain an equivalent excess of acid tend to form strong internal salts.

The fuel compositions of the present invention will contain a minor amount of (A) at least one hydrocarbon-soluble alkali or alkaline earth metal-containing composition. The presence of such metal-containing compositions in the fuel compositions of the present invention provides the fuel composition with a desirable ability to prevent or minimize valve seat recession in internal combustion engines, particularly when the fuel is an unleaded or low-lead fuel.

The choice of the metal does not appear to be particularly critical although alkali metals are preferred, with sodium being the preferred alkali metal.

The metal-containing composition (A) may be alkali metal or alkaline earth metal salts of sulfur acids, carboxylic acids, phenols and phosphorus acids. These salts can be neutral or basic. The former contain an amount of metal cation just sufficient to neutralize the acidic groups present in salt anion; the latter contain an excess of metal cation and are often termed overbased, hyperbased or superbased salts.

These basic and neutral salts can be of oil-soluble organic sulfur acids such as sulfonic, sulfamic, thiosulfonic, sulfinic, sulfenic, partial ester sulfuric, sulfurous and thiosulfuric acid. Generally they are salts of aliphatic or aromatic sulfonic acids.

The sulfonic acids include the mono- or poly-nuclear aromatic or cycloaliphatic compounds. The sulfonic acids can be represented for the most part by the following formulae:

$$R^1(SO_3H)_r \qquad \text{Formula I}$$

$$(R^2)_xT(SO_3H)_y \qquad \text{Formula II}$$

in which T is an aromatic nucleus such as, for example, benzene, naphthalene, anthracene, phenanthrene, diphenylene oxide, thianthrene, phenothioxine, diphenylene sulfide, phenothiazine, diphenyl oxide, diphenyl sulfide, diphenylamine, cyclohexane, petroleum naphthenes, decahydronaphthalene, cyclopentane, etc; $R^1$ and $R^2$ are each independently aliphatic groups, $R^1$ contains at least about 15 carbon atoms, the sum of the carbon atoms in $R^2$ and T is at least about 15, and r, x and y are each independently 1 or greater.

Specific examples of $R^1$ are groups derived from petrolatum, saturated and unsaturated paraffin wax, and polyolefins, including polymerized $C_2$, $C_3$, $C_4$, $C_5$, $C_6$, etc., olefins containing from about 15 to 7000 or more carbon atoms. The groups T, $R^1$ and $R^2$ in the above formulae can also contain other inorganic or organic substituents in addition to those enumerated above such as, for example, hydroxy, mercapto, halogen, nitro, amino, nitroso, sulfide, disulfide, etc. The subscript x is generally 1–3, and the subscripts $r+y$ generally have an average value of about 1–4 per molecule.

The following are specific examples of oil soluble sulfonic acids coming within the scope of Formulae I and II above, and it is to be understood that such examples serve also to illustrate the salts of such sulfonic acids useful in this invention. In other words, for every sulfonic acid enumerated it is intended that the corresponding neutral and basic metal salts thereof are also understood to be illustrated. Such sulfonic acids are mahogany sulfonic acids; bright stock sulfonic acids; sulfonic acids derived from lubricating oil fractions having a Saybolt viscosity from about 100 seconds at 100° F. (37.7° C.) to about 200 seconds at 210° F. (99° C.); petrolatum sulfonic acids; mono- and poly-wax substituted sulfonic and polysulfonic acids of, e.g., benzene, diphenylamine, thiopene, alpha-chloronaphthalene, etc.; other substituted sulfonic acids such as alkyl benzene sulfonic acids (where the alkyl group has at least 8 carbons), cetylphenol mono-sulfide sulfonic acids, dicetyl thianthrene disulfonic acids, dilauryl beta naphthyl sulfonic acids, and alkaryl sulfonic acids such as dodecyl benzene "bottoms" sulfonic acids.

The latter are acids derived from benzene which has been alkylated with propylene tetramers or isobutene trimers to introduce 1, 2, 3 or more branched-chain $C_{12}$ substituents on the benzene ring. Dodecyl benzene bottoms, principally mixtures of mono- and di-dodecyl benzenes, are available as by-products from the manufacturer of household detergents. Similar products obtained from alkylation bottoms formed during manufacture of linear alkyl sulfonates (LAS) are also useful in making the sulfonates used in this invention.

The production of sulfonates from detergent manufacture by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

Other descriptions of neutral and basic sulfonate salts and techniques for making them can be found in the following U.S. Pat. Nos.: 2,174,110; 2,174,506; 2,174,508; 2,193,824; 2,197,800; 2,202,781; 2,212,786; 2,213,360; 2,228,598; 2,223,676; 2,239,974; 2,263,312; 2,276,090; 2,276,097; 2,315,514; 2,319,121; 2,321,022; 2,333,568; 2,333,788; 2,335,259; 2,337,552; 2,347,568; 2,366,027; 2,374,193; 2,383,319; 3,312,618; 3,471,403; 3,488,284; 3,595,790 and 3,798,012. These are hereby incorporated by reference for their disclosures in this regard. Also included are aliphatic sulfonic acids such as paraffin wax sulfonic acids, unsaturated paraffin wax sulfonic acids, hydroxy-substituted paraffin wax sulfonic acids, hexapropylene sulfonic acids, tetra-amylene sulfonic acids, polyisobutene sulfonic acids wherein the polyisobutenecontains from 20 to 7000 or more carbon atoms, chlorosubstituted paraffin wax sulfonic acids, nitro-paraffin wax sulfonic acids, etc; cyclo-aliphatic sulfonic acids such as petroleum naphthene sulfonic acids, cetyl cyclopentyl sulfonic acids, lauryl cyclohexyl sulfonic acids, bis-(di-isobutyl)cyclohexyl sulfonic acids, mono- or poly-wax substituted cyclohexyl sulfonic acids, etc.

With respect to the sulfonic acids or salts thereof described herein and in the appended claims, it is intended herein to employ the term "petroleum sulfonic acids"or "petroleum sulfonates"to cover all sulfonic acids or the salts thereof derived from petroleum products. A particularly valuable group of petroleum sulfonic acids are the mahogany sulfonic acids (so called because of their reddish-brown color) obtained as a by-product from the manufacturer of petroleum white oils by a sulfuric acid process.

The carboxylic acids from which suitable neutral and basic alkali metal and alkaline earth metal salts for use in this invention can be made include aliphatic, cycloaliphatic, and aromatic mono and polybasic carboxylic acids such as the naphthenic acids, alkyl- or alkenyl-substituted cyclopentanoic acids, the corresponding cyclohexanoic acids and the corresponding aromatic acids. The aliphatic acids generally contain at least eight carbon atoms and preferably at least twelve carbon atoms. Usually they have no more than about 400 carbon atoms. Generally, if the aliphatic carbon chain is branched, the acids are more oil soluble for any given carbon atom content. The cycloaliphatic and aliphatic carboxylic acids can be saturated or unsaturated. Specific examples include 2-ethylhexanoic acid, alphalinolenic acid, propylenetetramer-substituted maleic acid, behenic acid, isostearic acid, pelargonic acid, capric acid, palmitoleic acid, linoleic acid, lauric acid, oleic acid, ricinoleic acid, undecylic acid, dioctylcyclopentane carboxylic acid, myristic acid, dilauryldecahydronaphthalene carboxylic acid, stearyl-octahydroindene carboxylic acid, palmitic acid, commercially available mixtures of two or more carboxylic acids such as tall oils acids, rosin acids, and the like.

A preferred group of oil-soluble carboxylic acids useful in preparing the salts used in the present invention are the oil-soluble aromatic carboxylic acids. These acids are represented by the general formula:

$$(R^*)_a Ar^*(CXXH)_m \qquad \text{Formula III}$$

where R* is an aliphatic hydrocarbon-based group of at least four carbon atoms, and no more than about 400 aliphatic carbon atoms, a is an integer of from one to four, Ar* is a polyvalent aromatic hydrocarbon nucleus of up to about 14 carbon atoms, each X is independently a sulfur or oxygen atom, and m is an integer of from one to four with the proviso that R* and a are such that there is an average of at least 8 aliphatic carbon atoms provided by the R* groups for each acid molecule represented by Formula III. Examples of aromatic nuclei represented by the variable Ar* are the polyvalent aromatic radicals derived from benzene, naphthalene, anthracene, phenanthrene, indene, fluorene, biphenyl, and the like. Generally, the radical represented by Ar* will be a polyvalent nucleus derived from benzene or naphthalene such as phenylenes and naphthlene, e.g., methylphenylenes, ethoxyphenylenes, nitrophenylenes, isopropylphenylenes, hydroxyphenylenes, mercaptophenylenes, N,N-diethylaminophenylenes, chlorophenylenes, dipropoxynaphthylenes, triethylnaphthylenes, and similar tri-, tetra-, pentavalent nuclei thereof, etc.

The R* groups are usually purely hydrocarbyl groups, preferably groups such as alkyl or alkenyl radicals. However, the R* groups can contain small number substituents such as phenyl, cycloalkyl (e.g., cyclohexyl, cyclopentyl, etc.) and nonhydrocarbon groups such as nitro, amino, halo (e.g., chloro, bromo, etc.) lower alkoxy, lower alkyl mercapto, oxo substituents (i.e.,=O), thio groups (i.e.,=S), interrupting groups such as —NH—, —O—, —S—, and the like provided the essentially hydrocarbon character of the R* group is retained. The hydrocarbon character is retained for purposes of this invention so long as any non-carbon atoms present in the R* group do not account for more than about 10% of the total weight of the R* groups.

Examples of R* groups include butyl, isobutyl, pentyl, octyl, nonyl, dodecyl, docosyl, tetracontyl, 5-chlorohexyl, 4-ethoxypentyl, 2-hexenyl, cyclohexyloctyl, 4-(p-chlorophenyl)octyl, 2,3,5-trimethylheptyl, 2-ethyl-5-methyloctyl, and substituents derived from polymerized olefins such as polychloroprenes, polyethylenes, polypropylenes, polyisobutylenes, ethylene-propylene copolymers, chlorinated olefin polymers, oxidized ethylene-propylene copolymers, and the like. Likewise, the group Ar may contain non-hydrocarbon substituents, for example, such diverse substituents as lower alkoxy, lower alkyl mercapto, nitro, halo, alkyl or alkenyl groups of less than four carbon atoms, hydroxy, mercapto and the like.

A group of particularly useful carboxylic acids are those of the formula:

$$R^*_aAr^*(CXXH)_m(XH)_p \qquad \text{Formula IV}$$

where R*, X, Ar*, m and a are as defined in Formula III and p is an integer of 1 to 4, usually 1 or 2. Within this group, an especially preferred class of oil-soluble carboxylic acids are those of the formula:

$$(R^{**})Ph_a(COOH)_b(OH)_c \qquad \text{Formula V}$$

where R in Formula V is an aliphatic hydrocarbon group containing at least 4 to about 400 carbon atoms, Ph is a phenyl group, a is an integer of from 1 to 3, b is 1 or 2, c is zero, 1, or 2 and preferably 1 with the proviso that R and a are such that the acid molecules contain at least an average of about twelve aliphatic carbon atoms in the aliphatic hydrocarbon substituents per acid molecule. And within this latter group of oil-soluble carboxylic acids, the aliphatic-hydrocarbon substituted salicylic acids wherein each aliphatic hydrocarbon substituent contains an average of at least about sixteen carbon atoms per substituent and one to three substituents per molecule are particularly useful. Salts prepared from such salicylic acids wherein the aliphatic hydrocarbon substituents are derived from polymerized olefins, particularly polymerized lower 1-mono-olefins such as polyethylene, polypropylene, polyisobutylene, ethylene/propylene co-polymers and the like and having average carbon contents of about 30 to 400 carbon atoms.

The carboxylic acids corresponding to Formulae III and IV above are well known or can be prepared according to procedures known in the art. Carboxylic acids of the type illustrated by the above formulae and processes for preparing their neutral and basic metal salts are well known and disclosed, for example, in such U.S. Pat. Nos. as 2,197,832; 2,197,835; 2,252,662; 2,252664; 2,714,092; 3,410,798 and 3,595,791.

Another type of neutral and basic carboxylate salt used in this invention are those derived from alkenyl succinates of the general formula:

$$R^*CH(COOH)CH_2COOH \qquad \text{Formula VI}$$

wherein R* is as defined above in Formula III. Such salts and means from making then are set forth in U.S. Pat. Nos. 3,271,310; 3,567,637 and 3,632,610.

Other patents specifically describing techniques for making basic salts of the hereinabove-described sulfonic acids, carboxylic acids, and mixtures of any two or more of these include U.S. Pat. Nos. 2,501,731; 2,616,904; 2,616,905; 2,616,906; 2,616,911; 2,616,924; 2,616,925; 2,617,049; 2,777,874; 3,027,325; 3,256,186; 3,282,835; 3,384,585; 3,373,108; 3,368,396; 3,342,733; 3,320,162; 3,312,618; 3,318,809; 3,471,403; 3,488,284; 3,595,790 and 3,629,109.

Neutral and basic salts of phenols (generally known as phenates) are also useful in the compositions of this invention and well known to those skilled in the art. The phenols from which these phenates are formed are of the general formula:

$$(R^*)_a—(Ar^*)—(OH)_m \qquad \text{Formula VII}$$

wherein R*, a, Ar*, and m have the same meaning and preferences as described hereinabove with reference to Formula III. The same examples described with respect to Formula III also apply. The commonly available class of phenates are those made from phenols of the general formula:

$$(R')_a(R^4)_zPh(OH)_b \qquad \text{Formula VIII}$$

wherein a is an integer of 1–3, b is of 1 or 2, z is 0 or 1, Ph is a phenyl group R' in Formula VIII is a substantially saturated hydrocarbon-based substituent having an average of from about 30 to about 400 aliphatic carbon atoms and $R^4$ is selected from the group consisting of lower alkyl, lower alkoxyl, nitro, and halo groups.

One particular class of phenates for use in this invention are the basic (i.e., overbased, etc.) alkali and alkaline earth metal sulfurized phenates made by sulfurizing a phenol and described hereinabove with a sulfurizing agent such as sulfur, a sulfur halide, or sulfide or hydrosulfide salt. Techniques for making these sulfurized phenates are described in U.S. Pat. Nos. 2,680,096; 3,036,971 and 3,775,321.

Other phenates that are useful are those that are made from phenols that have been linked through alkylene (e.g., methylene) bridges. These are made by reacting single or multi-ring phenols with aldehydes or ketones, typically, in the presence of an acid or basic catalyst. Such linked phenates as well as sulfurized phenates are described in detail in U.S. Pat. No. 3,350,038; particularly columns 6–8 thereof.

Alkali and alkaline earth metal salts of phosphorus acids also are useful in the fuel compositions of the invention. For example, the normal and basic salts of the phosphonic and/or thiophosphonic acids prepared by reacting inorganic phosphorus reagents such as $P_2S_5$ with petroleum fractions such as bright stock or polyolefins obtained from olefins of 2 to 6 carbon atoms. Particular examples of the polyolefins are polybutenes having a molecular weight of from 700 to 100,000. Other phosphorus-containing reagents which have been reacted with olefins include phosphorus trichloride or phosphorus trichloride-sulfur chloride mixture, (e.g., U.S. Pat. Nos. 3,001,981 and 2,195,517), phosphites and phosphite chlorides (e.g., U.S. Pat. Nos. 3,033,890 and 2,863,834), and air or oxygen with a phosphorus halide (e.g., U.S. Pat. No. 2,939,841).

Other patents describing phosphorus acids and metal salts useful in the present invention and which are prepared by reacting olefins with phosphrous sulfides include the following U.S. Pat. Nos.: 2,316,078; 2,316,079; 2,316,080; 2,316,281; 2,316,282; 2,316,085; 2,316,088; 2,375,315; 2,406,575; 2,496,508; 2,766,206; 2,838,484; 2,893,959 and 2,907,713. These acids which are described in the above patents as being oil additives, are useful in the fuel composition of the present invention.

The acids can be converted to neutral and basic salts by reactions which are well known in the art.

Mixtures of two or more neutral and basic salts of the hereinabove described organic sulfur acids, carboxylic acids, phosphorus acids and phenols can be used in the compositions of this invention. Usually the neutral and basic salts will be sodium, lithium, magnesium, calcium, or barium salts including mixtures of two or more of any of these.

As mentioned above, the amount of alkali or alkaline earth metal containing composition (A) included in the fuel composition will be an amount which is sufficient to provide from about 1 to about 100 parts per million of the alkali metal or alkaline earth metal in the fuel composition. When utilized in lead free or low lead fuels, the amount of alkali metal or alkaline earth metal-containing composition (A) included in the fuel is an amount which is sufficient to reduce valve seat recession when the fuel is used in an internal combustion engine.

An (a) alkali or alkaline earth metal containing composition is conveniently packaged with (b) the reaction product of the polycarboxylic acid and the polyhydroxyalkanolamine at a weight ratio of from about 150:1 to about 1:1, preferably from about 50:1 to about 3:1. The product containing the alkali metal or alkaline earth metal containing composition and the aforementioned reaction product are conveniently packaged such that the two active ingredients are present with a diluent such as mineral oil or other suitable hydrocarbon based material. In such a case, the combined active ingredients are typically present in a weight ratio of the diluent of about 10:1 to about 1:5 preferably about 8:1 to about 1:2.

The products as described herein are useful for the addition to a gasoline which either contains an insufficient amount of lead or no lead and which is expected to be used in an engine requiring valve seat recession protection. Low lead gasolines typically contain less than 0.5 grams of lead per liter. Unleaded gasolines are those in which no lead has been added and the lead content is essentially nil.

Gasolines are supplied in a number of different grades depending on the type of service for which they are intended. The gasolines utilized in the present invention include those designed as motor and aviation gasolines. Motor gasolines include those defined by ASTM specification D-439-73 and are composed of a mixture of various types of hydrocarbons including aromatics, olefins, paraffins, isoparaffins, napthenes and occasionally diolefins. Motor gasolines normally have a boiling range within the limits of about 20° C. to 230° C. while aviation gasolines have narrower boiling ranges, usually within the limits of about 37° C. to 165° C.

The fuel compositions of the present invention desirably also contain a minor amount of at least one hydrocarbon soluble ashless dispersant. The compounds useful as ashless dispersants generally are characterized by a "polar" group attached to a relatively high molecular weight hydrocarbon chain. The "polar" group generally contains one or more of the elements nitrogen, oxygen and phosphorus. The solubilizing chains are generally higher in molecular weight than those employed with the metallic types, but in some instances they may be suite similar.

In general, any of the ashless detergents which are known in the art for use in lubricants and fuels can be utilized in the fuel compositions of the present invention.

In one embodiment of the present invention, the dispersant is selected from the group consisting of (i) at least one hydrocarbyl-substituted amine wherein the hydrocarbyl substituent is substantially aliphatic and contains at least 8 carbon atoms;

(ii) at least one acylated, nitrogen-containing compound having a substituent of at least 10 aliphatic carbon atoms made by reacting a carboxylic acid acylating agent with at least one amino compound containing at least one

—NH— group, said acylating agent being linked to said amino compound through an imido, amido, amidine, or acyloxy ammonium linkage;

(iii) at least one nitrogen-containing condensate of a phenol, aldehyde and amino compound having at least one

—NH— group;

(iv) at least one ester of a substituted carboxylic acid;

(v) at least one polymeric dispersant;

(vi) at least one hydrocarbon substituted phenolic dispersant; and (vii) at least one fuel soluble alkoxylated derivative of an alcohol, phenol or amine.

The Hydrocarbyl-Substituted Amine

The hydrocarbyl-substituted amines used in the fuel compositions of this invention are well known to those of skill in the art and they are described in a number of patents. Among these are U.S. Pat. Nos. 3,275,554; 3,438,757; 3,454,555; 3,565,804; 3,755,433 and 3,822,209. These patents disclose suitable hydrocarbyl amines for use in the present invention including their method of preparation.

A typical hydrocarbyl amine has the general formula:

$$[AXN]_x[-N([-UN-]_a[-UQ]_b)]_yR^2_cH_{1+2y+ay-c} \quad \text{Formula IX}$$

wherein A is hydrogen, a hydrocarbyl group of from 1 to about 10 carbon atoms, or hydroxyhydrocarbyl group of from 1 to 10 carbon atoms; X is hydrogen, a hydrocarbyl group of from 1 to 10 carbon atoms, or hydroxyhydrocarbyl group of from 1 to 10 carbon atoms, and may be taken together with A and N to form a ring of from 5 to 6 annular members and up to 12 carbon atoms; U is an alkylene group of from 2 to 10 carbon atoms, any necessary hydrocarbons to accommodate the trivalent nitrogens are implied herein, $R^2$ is an aliphatic hydrocarbon of from about 30 to 400 carbon atoms; Q is a piperazine structure; a is an integer of from 1 to 10; b is an integer of from 0 to 1; a+2b is an integer of from 1 to 10; c is an integer of from about 1 to 5 and is an average in the range of 1 to 4, and equal to or less than the number of nitrogen atoms in the molecule; x is an integer of from 0 to 1; y is an integer of from about 0 to 1; and x+y is equal to 1.

In interpreting this formula, it is to be understood that the $R^2$ and H atoms are attached to the unsatisfied nitrogen valences within the brackets of the formula. Thus, for example, the formula includes sub-generic formulae wherein the $R^2$ is attached to terminal nitrogens and isomeric subgeneric formula wherein it is attached to non-terminal nitrogen atoms. Nitrogen atoms not attached to an $R^2$ may bear a hydrogen or an AXN substituent.

The hydrocarbyl amines useful in this invention and embraced by the above formula include monoamines of the general formula:

$$AXNR^2 \qquad \text{Formula X}$$

Illustrative of such monoamines are the following:

poly(propylene)amine
N,N-dimethyl-n-poly(ethylene/propylene)amine (50:50 mole ratio of monomers)
poly(isobutene)amine
N,N-di(hydroxyethyl)-N-poly(isobutene)amine
poly(isobutene/1-butene/2-butene)amine (50:25:25 mole ratio of monomer)
N-(2-hydroxyethyl)-N-poly(isobutene)amine
N-(2-hydroxypropyl)-N-poly(isobutene)amine
N-poly(1-butene)-aniline
N-poly(isobutene)-morpholine Among the hydrocarbyl amines embraced by the general Formula IX as set forth above, are polyamines of the general formula:

$$-N([-UN-]_a[-UQ]_b)R^2{}_cH_{1+2y+ay-c} \qquad \text{Formula XI}$$

Illustrative of such polyamines are the following:

N-poly(isobutene) ethylene diamine
N-poly(propylene) trimethylene diamine
N-poly(1-butene) diethylene triamine
N′,N′-poly(isobutene) tetraethylene pentamine
N,N-dimethyl-N′-poly(propylene), 1,3-propylene diamine The hydrocarbyl substituted amines useful in the fuel compositions of this invention include certain N-aminohydrocarbyl morpholines which are not embraced in the general Formula IX above. These hydrocarbyl-substituted aminohydrocarbyl morpholines have the general formula:

$$R^2N(A)UM \qquad \text{Formula XII}$$

wherein $R^2$ is an aliphatic hydrocarbon group of from about 30 to about 400 carbons, A is hydrogen, hydrocarbyl of from 1 to 10 carbon atoms or hydroxy hydrocarbyl group of from 1 to 10 carbon atoms, U is an alkylene group of from 2 to 10 carbon atoms, and M is a morpholine structure. These hydrocarbyl-substituted aminohydrocarbyl morpholines as well as the polyamines described by Formula X are among the typical hydrocarbyl-substituted amines used in preparing compositions of this invention.

The Acylated Nitrogen-Containing Compounds

A number of acylated, nitrogen-containing compounds having a substituent of at least 10 aliphatic carbon atoms and made by reacting a carboxylic acid acylating agent with an amino compound are known to those skilled in the art. In such compositions the acylating agent is linked to the amino compound through an imido, amido, amidine or acyloxy ammonium linkage. The substituent of 10 aliphatic carbon atoms may be in either the carboxylic acid acylating agent derived portion of the molecule or in the amino compound derived portion of the molecule. Preferably, however, it is in the acylating agent portion. The acylating agent can vary from formic acid and its acylating derivatives to acylating agents having high molecular weight aliphatic substituents of up to 5,000, 10,000 or 20,000 carbon atoms. The amino compounds can vary from ammonia itself to amines having aliphatic substituents of up to about 30 carbon atoms.

A typical class of acylated amino compounds useful in the compositions of this invention are those made by reacting an acylating agent having an aliphatic substituent of at least 10 carbon atoms and a nitrogen compound characterized by the presence of at least one —NH— group. Typically, the acylating agent will be a mono- or polycarboxylic acid (or reactive equivalent thereof) such as a substituted succinic or propionic acid and the amino compound will be a polyamine or mixture of polyamines, most typically, a mixture of ethylene polyamines. The amine also may be a hydroxyalkyl-substituted polyamine. The aliphatic substituent in such acylating agents preferably averages at least about 30 or 50 and up to about 400 carbon atoms.

Illustrative hydrocarbon based groups containing at least ten carbon atoms are n-decyl, n-dodecyl, tetrapropenyl, n-octadecyl, oleyl, chlorooctadecyl, triicontanyl, etc. Generally, the hydrocarbon-based sub-stituents are made from homo- or interolymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. Typically, these olefins are 1-monooleins. The substituent can also be derived from the halogenated (e.g., chlorinated or brominated) analogs of such homo- or interpolymers. The substituent can, however, be made from other sources, such as monomeric high molecular weight alkenes (e.g., 1-tetra-contene) and chlorinated analogs and hydrochlorinated analogs thereof, aliphatic petroleum fractions, particularly paraffin waxes and cracked and chlorinated analogs and hydrochlorinated analogs thereof, while oils, synthetic alkenes such as those produced by the Ziegler-Natta process (e.g., poly(ethylene) greases) and other sources known to those skilled in the art. Any unsaturation in the substituent may be reduced or eliminated by hydrogenation according to procedures known in the art.

As used in this specification and appended claims, the term "hydrocarbon-based" denotes a group having a carbon atom directly attached to the remainder of the molecule and having a predominantly hydrocarbon character within the context of this invention. Therefore, hydrocarbon-based groups can contain up to one non-hydrocarbon group for every ten carbon atoms provided this non-hydrocarbon group does not significantly alter the predominantly hydrocarbon character of the group. Those skilled in the art will be aware of such groups, which include, for example, hydroxyl, halo (especially chloro and fluoro), alkoxyl, alkyl mercapto, alkyl sulfoxy, etc. Usually, however, the hydrocarbon-based substituents are purely hydrocarbyl and contain no such non-hydrocarbyl groups.

The hydrocarbon-based substituents are substantially saturated, that is, they contain no more than one carbon-to-carbon unsaturated bond for every ten carbon-to-carbon single bonds present. Usually, they contain no more than one carbon-to-carbon non-aromatic unsaturated bond for every 50 carbon-to-carbon bonds present.

The hydrocarbon-based substituents are also substantially aliphatic in nature, that is, they contain no more than one non-aliphatic moiety (cycloalkyl, cycloalkenyl or aromatic) group of six or less carbon atoms for every ten carbon atoms in the substituent. Usually, however, the substituents contain no more than one such non-aliphatic group for every fifty carbon atoms, and in many cases, they contain no such non-aliphatic groups at all; that is, the typical substituents are purely aliphatic. Typically, these purely aliphatic substituents are alkyl or alkenyl groups.

Specific examples of the substantially saturated hydrocarbon-based substituents containing an average of more than 30 carbon atoms are the following:

- a mixture of poly(ethylene/propylene) groups of about 35 to about 70 carbon atoms
- a mixture of the oxidatively or mechanically degraded poly(ethylene/propylene) groups of about 35 to about 70 carbon atoms
- a mixture of poly(propylene/1-hexene) groups of about 80 to about 150 carbon atoms
- a mixture of poly(isobutene) groups having an average of 50 to 75 carbon atoms.

A preferred source of the substituents are poly(isobutene)s obtained by polymerization of a $C_4$ refinery stream having a butene content of 35 to 75 weight percent and isobutene content of 30 to 60 weight percent in the presence of a Lewis acid catalyst such as aluminum trichloride or boron trifluoride. These polybutenes contain predominantly (greater than 80% of total repeating units) isobutene repeating units of the configuration:

$$-C(CH_3)_2CH_2-$$

Exemplary of amino compounds useful in making these acylated compounds are the following:

(1) polyalkylene polyamines of the general formula:

$$(R^3)_2N[U-N(R^3)]_nR^3 \qquad \text{Formula XIII}$$

wherein each $R^3$ is independently a hydrogen atom, a hydrocarbyl group or a hydroxy-substituted hydrocarbyl group containing up to about 30 carbon atoms, with proviso that at least one $R^3$ is a hydrogen atom, n is a whole number of 1 to 10 and U is a $C_{1-8}$ alkylene group, (2) heterocyclic-substituted polyamines including hydroxyalkyl-substituted polyamines wherein the polyamines are described above and the heterocyclic substituent is e.g., a piperazine, an imidazoline, a pyrimidine, a morpholine, etc., and (3) aromatic polyamines of the general formula:

$$Ar(NR^3{}_2)_y \qquad \text{Formula XIV}$$

wherein Ar is a aromatic nucleus of 6 to about 20 carbon atoms, each R''' is as defined hereinabove and y is 2 to about 8. Specific examples of the polyalkylene polyamines (1) are ethylene diamine, tetra(ethylene)-pentamine, tri-(trimehylene)tetramine, 1,2-propylene diamine, etc. Speciic examples of hydroxyalkyl-substituted polyamines include N-(2-hydroxyethyl) ethylene diamine, N,N$^1$-bis-(2-hydroxyethyl) ethylene diamine, N-(3-hydroxybutyl) tetramethylene diamine, etc. Specific examples of the heterocyclic-substituted polyamines (2) are N-2-aminoethyl piperazine, N-2 and N-3 amino propyl morpholine, N-3(dimethyl amino) propyl piperazine, 2-heptyl-3-(2-aminopropyl) imidazoline, 1,4-bis (2-aminoethyl) piperazine, 1-(2-hydroxy ethyl) piperazine, and 2-heptadecyl-1-(2-hydroxyethyl)-imidazoline, etc. Specific examples of the aromatic polyamines (3) are the various isomeric phenylene diamines, the various isomeric naphthalene diamines, etc.

Many patents have described useful acylated nitrogen compounds including U.S. Pat. Nos. 3,172,892; 3,219,666; 3,272,746; 3,310,493; 3,341,542; 3,444,170; 3,455,831; 3,455,832; 3,576,743; 3,630,904; 3,632,511; 3,804,763 and 4,234,435. A typical acylated nitrogen-containing compound of this class is that made by reacting a poly(isobutene)-substituted succinic anhydride acylating agent (e.g., anhydride, acid, ester, etc.) wherein the poly(isobutene) substituent has between about 50 to about 400 carbon atoms which a mixture of ethylene polyamines having 3 to about 7 amino nitrogen atoms per ethylene polyamine and about 1 to about 6 ethylene chloride. In view of the extensive disclosure of this type of acylatd amino compound, further discussion of their nature and method of preparation is not needed here. The above-noted U.S. Patents are utilized for their disclosure of acylated amino compounds and their method of preparation.

Another type of acylated nitrogen compound belonging to this class is that made by reacting the afore-described alkylene amines with the afore-described substituted succinic acids or anhydrides and aliphatic mono-carboxylic acids having from 2 to about 22 carbon atoms. In these types of acylated nitrogen compounds, the mole ratio of succinic acid to mono-carboxylic acid ranges from about 1:0.1 to about 1:1. Typical of the mono-carboxylic acid are formic acid, acetic acid, dodecanoic acid, butanoic acid, oleic acid, stearic acid, the commercial mixture of stearic acid isomers known as isostearic acid, tolyl acid, etc. Such materials are more fully described in U.S. Pat. Nos. 3,216,936 and 3,250,715.

Still another type of acylated nitrogen compound useful in making the fuels of this invention is the product of the reaction of a fatty monocarboxylic acid of about 12–30 carbon atoms and the afore-described alkylene amines, typically, ethylene, propylene or trimethylene polyamines containing 2 to 8 amino groups and mixtures thereof. The fatty mono-carboxylic acids are generally mixtures of straight and branched chain fatty carboxylic acids containing 12–30 carbon atoms. A widely used type of acylated nitrogen compound is made by reacting the afore-described alkylene polyamines with a mixture of fatty acids having from 5 to about 30 mole percent straight chain acid and about 70 to about 95 percent mole branched chain fatty acids. Among the commercially available mixtures are those known widely in the trade as isostearic acid. These mixtures are produced as a a by-product from the dimerization of unsaturated fatty acids as described in U.S. Pat. Nos. 2,812,342 and 3,260,671.

The branched chain fatty acids can also include those in which the branch is not alkyl in nature, such as found in phenyl and cyclohexyl stearic acid and the chlorostearic acids. Branched chain fatty carboxylic acid-/alkylene polyamine products have been described extensively in the art. See for example, U.S. Pat. Nos. 3,110,673; 3,251,853; 3,326,801; 3,337,459; 3,405,064; 3,429,674; 3,468,639; 3,857,791. These patents are utilized for their disclosure of fatty acid/polyamine condensates for their use in lubricating oil formulations.

The Nitrogen-Containing Condensates of Phenols, Aldehydes, and Amino Compounds The phenol/aldehyde/amino compound condensates useful as dispersants in the fuel compositions of this invention include those generically referred to as Mannich condensates. Generally they are made by reacting simultaneously or sequentially at least one active hydrogen compound such as a hydrocarbon-substituted phenol (e.g., and alkyl phenol wherein the alkyl group has at least an average of about 12 to 400; preferably 30 up to about 400 carbon atoms), having at least one hydrogen atom bonded to an aromatic carbon, with at least one aldehyde or aldehyde-producing material (typically formaldehyde precursor) and at least one amino or polyamino compound having at least one NH group. The amino compounds include primary or secondary monoamines having hydrocarbon substituents of 1 to 30 carbon atoms or hydroxyl-substituted hydrocarbon substituents of 1 to about 30 carbon atoms. Another type of typical amino compound are the polyamines described during the discussion of the acylated nitrogen-containing compounds.

Exemplary mono-amines include methyl ethyl amine, methyl octadecyl amines, aniline, diethyl amine, diethanol amine, dipropyl amine and so forth. The following U.S. Patents contain extensive descriptions of Mannich condensates which can be used in making the compositions of this invention:

| U.S. Pat. Nos. | | |
|---|---|---|
| 2,459,112 | 3,413,347 | 3,558,743 |
| 2,962,442 | 3,442,808 | 3,586,629 |
| 2,984,550 | 3,448,047 | 3,591,598 |
| 3,036,003 | 3,454,497 | 3,600,372 |
| 3,166,516 | 3,459,661 | 3,634,515 |
| 3,236,770 | 3,461,172 | 3,649,229 |
| 3,355,270 | 3,493,520 | 3,697,574 |
| 3,368,972 | 3,539,633 | |

Condensates made from sulfur-containing reactants also can be used in the fuel compositions of the present invention. Such sulfur-containing condensates are described in U.S. Pat. Nos. 3,368,972; 3,649,229; 3,600,372; 3,649,659 and 3,741,896. These patents also disclose sulfur-containing Mannich condensates. Generally the condensates used in making compositions of this invention are made from a phenol bearing an alkyl substituent of about 6 to about 400 carbon atoms, more typically, 30 to about 250 carbon atoms. These typical condensates are made from formaldehyde or $C_{2-7}$ aliphatic aldehyde and an amino compound such as those used in making the acylated nitrogen-containing compounds described under (B) (ii).

These preferred condensates are prepared by reacting about one molar portion of phenolic compound with about 1 to about 2 molar portions of aldehyde and about 1 to about 5 equivalent portions of amino compound (an equivalent of amino compound is its molecular weight divided by the number of =NH groups present). The conditions under which such condensation reactions are carried out are well known to those skilled in the art as evidenced by the above-noted patents. Therefore, these patents are also incorporated by reference for their disclosures relating to reaction conditions.

A particularly preferred class of nitrogen-containing condensation products for use in the fuels of the present invention are those made by a "2-step process" as disclosed in commonly assigned U.S. Ser. No. 451,644, filed Mar. 15, 1974 now abandoned. Briefly, these nitrogen-containing condensates are made by (1) reacting at least one hydroxy aromatic compound containing an aliphatic-based or cycloaliphatic-based substituent which has at least about 30 carbon atoms and up to about 400 carbon atoms with a lower aliphatic $C_{1-7}$ aldehyde or reversible polymer thereof in the presence of an alkaline reagent, such as an alkali metal hydroxide, at a temperature up to about 150° C.; (2) substantially neutralizing the intermediate reaction mixture thus formed; and (3) reacting the neutralized intermediate with at least one compound which contains an amino group having at least one —NH— group.

More preferably, these 2-step condensates are made from (a) phenols bearing a hydrocarbon-based substituent having about 30 to about 250 carbon atoms, said substituent being derived from a polymer of propylene, 1-butene, 2-butene, or isobutene and (b) formaldehyde, or reversible polymer thereof, (e.g., trioxane, paraformaldehyde) or functional equivalent thereof, (e.g., methylol) and (c) an alkylene polyamine such as ethylene polyamines having between 2 and 10 nitrogen atoms. Further details as to this preferred class of condensates can be found in the hereinabove noted U.S. Ser. No. 451,644, which is hereby incorporated by reference, for its disclosures relating to 2-step condensates.

The Esters of Substituted Carboxylic Acids

The esters useful as detergents/dispersants in this invention are derivatives of substituted carboxylic acids in which the substituent is a substantially aliphatic, substantially saturated hydrocarbon-based group containing at least about 30 (preferably about 50 to about 750) aliphatic carbon atoms. As used herein, the term "hydrocarbon-based group" denotes a group having a carbon atom directly attached to the remainder of the molecule and having predominantly hydrcarbon character within the context of this invention. Such groups include the following:

(1) Hydrocarbon groups; that is, aliphatic groups, aromatic- and alicyclic-substituted aliphatic groups, and the like, of the type know to those skilled in the art.

(2) Substituted hydrocarbon groups; that is, groups containing non-hydrocarbon substituents which, in the context of this invention, do not alter the predominantly hydrocarbon character of the group. Those skilled in the art will be aware of suitable substituents; examples are halo, nitro, hydroxy, alkoxy, carbalkoxy and alkythio.

(3) Hetero groups; that is, groups which, while predominantly hydrocarbon in character within the context of this invention, contain atoms other than carbon present in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydro-carbon-based group.

The substituted carboxylic acids (and derivatives thereof including esters, amides and imides) are normally prepared by the alkylation of an unsaturated acid, or a derivative thereof such as an anhydride, ester, amide or imide, with a source of the desired hydrocarbon-based group. Suitable unsaturated acids and derivatives thereof include acrylic acid, methacrylic acid, maleic acid, maleic anhydride, fumaric acid, itaconic acid, itaconic anhydride, citraconic acid, citraconic anhydride, mesaconic acid, glutaconic acid, chloromaleic acid, aconitic acid, crotonic acid, methylcrotonic acid, sorbic acid, 3-hexenoic acid, 10-decenoic acid nd 2-pentene-1,3,5-tricarboxylic acid. Particularly preferred are the unsaturated dicarboxylic acids and their derivatives, especially maleic acid, fumaric acid and maleic anhydride.

Suitable alkylating agents include homopolymers and interpolymers of polymerizable olefin monomers containing from about 2 to about 10 and usually from about 2 to about 6 carbon atoms, and polar substituent-containing derivatives thereof. Such polymers are substantially saturated (i.e., they contain no more than about 5% olefinic linkages) and substantially aliphatic (i.e., they contain at least about 80% and preferably at least about 95% by weight of units derived from aliphatic monoolefins). Illustrative monomers which may be used to produce such polymers are ethylene, propylene, 1-butene, 2-butene, isobutene, 1-octene and 1-decene. Any unsaturated units may be derived from conjugated dienes such as 1,3-butadiene and isoprene; non-conjugated dienes such as 1,4-hexadiene, 1,4-cyclohexadiene, 5-ethylidene-2-norbornene and 1,6-octadiene: and trienes such as 1-isopropylidene-3a,4,7,-7a-tetrahydroindene, 1-isopropylidenedicyclopentadiene and 2-(2-methylene-4-methyl-3-pentenyl) [2.2.1]bicyclo-5-heptene.

A first preferred class of polymers comprises those of terminal olefins such as propylene, 1-butene, isobutene and 1-hexene. Especially preferred within this class are polybutenes comprising predominantly isobutene units. A second preferred class comprises terpolymers of ethylene, a $C_{3-8}$ alpha-monoolefin and a polyene selected from the group consisting of non-conjugated dienes (which are especially preferred) and trienes. Illustrative of these terpolyers is "Ortholeum 2052" manufactured by E. I. duPont de Nemours & Company, which is a terpolymer containing about 48 mole percent ethylene groups, 48 mole percent propylene groups and 4 mole percent 1,4-hexadiene groups and having an inherent viscosity of 1.35 (8.2 grams of polymer in 10 ml. of carbon tetrachloride at 30° C.).

Methods for the preparation of the substituted carboxylic acids and derivatives thereof are well known in the art and need not be described in detail. Reference is made, for example, to U.S. Pat. Nos. 3,272,746; 3,522,179; and 4,234,435 which are incorporated by reference herein. The mole ratio of the polymer to the unsaturated acid or derivative thereof may be equal to, greater than or less than 1, depending on the type of product desired.

The esters are those of the above-described succinic acids with hydroxy compounds which may be aliphatic compounds such as monohydric and polyhydric alcohols or aromatic compounds such as phenols and naphthols. The aromatic hydroxy compounds from which the esters of this invention may be derived are illustrated by the following specific examples: phenol, beta-naphthol, alpha-naphthol, cresol, resorcinol, catechol, p,p'-di-hydroxybiphenyl, 2-chlorophenol, 2,4-dibutylphenol, propene tetramer-substituted phenol, didodecylphenol, 4,4'-methylene-bis-phenol, alpha-decyl-beta-naphthol, polyisobutene (molecular weight of 1000)-substituted phenol, the condensation product of heptylphenol with 0.5 mole of formaldehyde, the condensation product of octyl-phenol with acetone, di(hydroxyphenyl)-oxide, di(hydroxy-phenyl) sulfide, di(hydroxyphenyl)disulfide, and 4-cyclo-hexylphenol. Phenol and alkylated phenols having up to three alkyl substituents are preferred. Each of the alkyl substituents may contain 100 or more carbon atoms.

The alcohols from which the esters may be derived preferably contain up to about 40 aliphatic carbon atoms. They may be monohydric alcohols such as methanols, ethanol, isooctanol, dodecanol, cyclohexanol, cyclopentanol, behenyl alcohol, hexatriacontonal, neopentyl alcohol, isobutyl alcohol, benzyl alcohol, beta-phenyl-ethyl alcohol, 2-methylcyclohexanol, beta-chloroethanol, monomethyl ether of ethylene glycol, monobutyl ether of ethylene glycol, monopropyl ether of diethylene glycol, monododecyl ether of triethylene glycol, monooleate of ethylene glycol, monostearate of diethylene glycol, sec-pentyl alcohol, tert-butyl alcohol, 5-bromo-dodecanol, nitro-octadecanol and dioleate of glycerol. The polyhydric alcohols preferably contain from 2 to about 10 hydroxy radicals. They are illustrated by, for example, ethylene glycol, diethylene glycol, triethylene glycol, tetraethylene glycol, dipropylene glycol, tripropylene glycol, dibutylene glycol, tributylene glycol, and other alkylene glycols in which the alkylene radical contains from 2 to about 8 carbon atoms. Other useful polyhydric alcohols include glycerol, mono-oleate of glycerol, monostearate of glycerol, monomethyl ether of glycerol, pentaerythritol, 9,10-dihydroxy stearic acid, methyl ester of 9,10-dihydroxy stearic acid, 1,2-butanediol, 2,3-hexanediol, 2,4-hexanediol, pinacol, erythritol, arabitol, sorbitol, mannitol, 1,2-cyclohexanediol, and xylene glycol. Carbohydrates such as sugars, starches, cellulose, etc., likewise may yield the esters of this invention. The carbohydrates may be exemplified by a glucose, fructose, sucrose, rhamnose, mannose, glyceraldehyde, and galactose.

An especially preferred class of polyhydric alcohols are those having at least three hydroxy radicals, some of which have been esterified with a monocarboxylic acid having from about 8 to about 30 carbon atoms, such as octanoic acid, oleic acid, stearic acid, linoleic acid, dodecanoic acid, or tall oil acid. Examples of such partially esterified polyhydric alcohols are the mono-oleate of sorbitol, distearate of sorbitol, monooleate of glycerol, monostearate of glycerol, di-dodecanoate of erythritol.

The esters may also be derived from unsaturated alcohols such as allyl alcohol, cinnamyl alcohol, propargyl alcohol, 1-cyclohexene-3-ol, and oleyl alcohol. Still another class of the alcohols capable of yielding the esters of this invention comprises the ether-alcohols and amino-alcohols including, for example, the oxyalkylene-, oxyarylene-, amino-alkylene-, and amino-arylene-substituted alcohols having one or more oxy-alkylene, amino-alkylene or amino-arylene oxy-arylene radicals. They are exemplified by Cellosolve, carbitol, phenoxyethanol, heptylphenyl-(oxypropylene)$_6$-H, octyl-(oxyethylene)$_{30}$-H, phenyl-(oxyoctylene)$_2$-H, mono(heptylphenyloxypropylene)-substituted glycerol, poly(styrene oxide), amino-ethanol, 3-amino ethyl-pentanol, di(hydroxyethyl)amine, p-amino-phenol, tri(hydroxypropyl-)amino, N-hydroxyethyl ethylene diamine, N,N,N',N'-tetrahydroxytrimethylene diamine, and the like. For the most part, the ether-alcohols having up to about 150 oxyalkylene radicals in which the alkylene radical contains from 1 to about 8 carbon atoms are preferred.

The esters may be di-esters of succinic acids or acidic esters, i.e., partially esterified polyhydric alcohols or phenols, i.e., esters having free alcoholic or phenolic hydroxyl radicals. Mixtures of the above-illustrated esters likewise are contemplated within the scope of the invention.

The esters may be prepared by one of several methods. The method which is preferred because of convenience and superior properties of the esters it produces, involves the reaction of a suitable alcohol or phenol with a substantially hydrocarbon-substituted succinic anhydride. The esterification is usually carried out at a temperature above about 100° C., preferably between 150° C. and 300° C.

The water formed as a by-product is removed by distillation as the esterification proceeds. A solvent may be used in the esterification to facilitate mixing and temperature control. It also facilitates the removal of water from the reaction mixture. The useful solvents include xylene, toluene, diphenyl ether, chlorobenzene, and mineral oil.

A modification of the above process involves the replacement of the substituted succinic anhydride with the corresponding succinic acid. However, succinic acids readily undergo dehydration at temperatures above about 100° C. and are thus converted to their anhydrides which are then esterified by the reaction with the alcohol reactant. In this regard, succinic acids appear to be the substantial equivalent of their anhydrides in the process.

The relative proportions of the succinic reactant and the hydroxy reactant which are to be used depend to a large measure upon the type of the product desired and the number of hydroxyl groups present in the molecule of the hydroxy reactant. For instance, the formation of a half ester of a succinic acid, i.e., one in which only one of the two acid radicals is esterified, involves the use of one mole of a monohydric alcohol for each mole of the substituted succinic acid reactant, whereas the formation of a diester of a succinic acid involves the use of two moles of the alcohol for each mole of the acid. On the other hand, one mole of a hexahydric alcohol may combine with as many as six moles of a succinic acid to form an ester in which each of the six hydroxyl radicals of the alcohol is esterified with one of the two acid radicals of the succinic acid. Thus, the maximum proportion of the succinic acid to be used with a polyhydric alcohol is determined by the number of hydroxyl groups present in the molecule of the hydroxy reactant. For the purposes of this invention, it has been found tha esters obtained by the reaction of equimolar amounts of the succinic acid reactant and hydroxy reactant have superior properties and are therefore preferred.

In some instances, it is advantageous to carry out the esterification in the presence of a catalyst such as sulfuric acid, pyridine hydrochloride, hydrochloric acid, benzenesulfonic acid, p-toluenesulfonic acid, phosphoric acid, or any other known esterification catalyst. The amount of the catalyst in the reaction may be as little as 0.01% (by weight of the reaction mixture), more often from about 0.1% to about 5%.

The esters of this invention likewise may be obtained by the reaction of a substituted succinic acid or anhydride with an epoxide or a mixture of a epoxide and water. Such reaction is similar to one involving the acid or anhydride with a glycol. For instance, the product may be prepared by the reaction of a substituted succinic acid with one mole of ethylene oxide. Similarly, the product may be obtained by the reaction of a substituted succinic acid with two moles of ethylene oxide. Other epoxides which are commonly available for use in such reaction include, for example, propylene oxide, styrene oxide, 1,2-butylene oxide, 2,3-butylene oxide, epichlorohydrin, cyclohexene oxide, 1,2-octylene oxide, epoxidized soya bean oil, methyl ester of 9,10-epoxy-stearic acid, and butadiene mono-epoxide. For the most part, the epoxides are the alkylene oxides in which the alkylene radical has from 2 to about 8 carbon atoms; or the epoxidized fatty acid esters in which the fatty acid radical has up to about 30 carbon atoms and the ester radical is derived from a lower alcohol having up to about 8 carbon atoms.

In lieu of the succinic acid or anhydride, a lactone acid or a substituted succinic acid halide may be used in the processes illustrated above for preparing the esters of this invention. Such acid halides may be acid dibromides, acid dichlorides, acid monochlorides, and acid monobromides. The substituted succinic anhydrides and acids can be prepared by, for example, the reaction of maleic anhydride with a high molecular weight olefin or a halogenated hydrocarbon such as is obtained by the chlorination of an olefin polymer described previously. The reaction involves merely heating the reactants at a temperature preferably from about 100° C. to about 250° C. The product from such a reaction is an alkenyl succinic anhydride. The alkenyl group may be hydrogenated to an alkyl group. The anhydride may be hydrolyzed by treatment with water or steam to the corresponding acid. Another method useful for preparing the succinic acids or anhydrides involves the reaction of itaconic acid or anhydride with an olefin or a chlorinated hydrocarbon at a temperature usually within the range from about 100° C. to about 250° C. The succinic acid halides can be prepared by the reaction of the acids or their anhydrides with a halogenation agent such as phosphorus tribromide, phosphorus pentachloride, or thionyl chloride. These and other methods of preparing the succinic compounds are well known in the art and need not be illustrated in further detail here.

Still other methods of preparing the esters useful in the fuels of this invention are available. For instance, the esters may be obtained by the reaction of maleic acid or anhydride with an alcohol such as is illustrated above to form a mono- or di-ester of maleic acid and then the reaction of this ester with an olefin or a chlorinated hydrocarbon such as is illustrated above. They may also be obtained by first esterifying itaconic anhydride or acid and subsequently reacting the ester intermediate with an olefin or a chlorinated hydrocarbon under conditions similar to those described hereinabove.

The Polymeric Dispersants

A large number of different types of polymeric dispersants have been suggested as useful in lubricating oil formulations, and such polymeric dispersants are useful in the fuel compositions of the present invention. Often, such additives have been described as being useful in lubricating formulations as viscosity index improvers with dispersing characteristics. The polymeric dispersants generally are polymers or copolymers having a long carbon chain and containing "polar" compounds to impart the dispersancy characteristics. Polar groups which may be included include amines, amides, imines, imides, hydroxyl, ether, etc. For example, the polymeric dispersants may be copolymers of methacrylates or acrylates containing additional polar groups, ethylene-propylene copolymers containing polar groups or vinyl acetatefumaric acid ester copolymers.

Many such polymeric dispersants have been described in the prior art, and it is not believed necessary to list in detail the various types. The following are examples of patents describing polymeric dispersants. U.S. Pat. No. 4,402,844 describes nitrogen-containing copolymers prepared by the reaction of lithiated hydrogenated conjugated dienes monovinylarene copolymers with substituted aminolactans. U.S. Pat. No. 3,356,763 describes a process for producing block copolymers of dienes such as 1,3-butadiene and vinyl aromatic hydrocarbons such as ethyl styrenes. U.S. Pat. No. 3,891,721 describes block polymers of styrene-butadiene-2-vinyl pyridine.

A number of the polymeric dispersants may be prepared by the grafting polar monomers to polyolefinic backbones. For example, U.S. Pat. Nos. 3,687,849 and 3,687,905 describe the use of maleic anhydrides as a graft monomer to a polyolefinic backbone. Maleic acid or anhydride is particularly desirable as a graft monomer because this monomer is relatively inexpensive, provides an economical route to the incorporation of dispersant nitrogen compounds into polymers by further reaction of the carboxyl groups of the maleic acid or anhydride with, for example, nitrogen compounds or hydroxy compounds. U.S. Pat. No. 4,160,739 describes graft copolymers obtained by the grafting of a monomer system comprising maleic acid or anhydride and at least one other different monomer which is addition copolymerizable therewith, the grafted monomer system then being post-reacted with a polyamine. The monomers which are copolymerizable with maleic acid or anhydride are any alpha, beta-monoethylenically unsaturated monomers which are sufficiently soluble in the reaction medium and reactive towards maleic acid or anhydride so that substantially larger amounts of maleic acid or anhydride can be incorporated into the grafted polymeric product. Accordingly, suitable monomers include the esters, amides and nitriles of acrylic acid methacrylic acid, and monomers containing no free acid groups. The inclusion of heterocyclic monomers into graft polymers is described by a process which comprises a first step of graft polymerizing an alkyl ester of acrylic acid or methacrylic acid, alone or an combination with styrene, onto a backbone copolymer which is a hydrogenated block copolymer of styrene and a conjugated diene having 4 to 6 carbon atoms to form a first graft polymer. In the second step, a polymerizable heterocyclic monomer, alone or in combination with a hydrophobizing vinyl ester is co-polymerized onto the first graft copolymer to form a second graft copolymer.

Other patents describing graft polymers useful as dispersants in the fuels of this invention include U.S. Pat. Nos. 3,243,481; 3,475,514; 3,723,575; 4,026,167; 4,085,055; 4,181,618; and 4,476,283.

Another class of polymeric dispersant useful in the fuel compositions of the invention are the so-called "star" polymers and copolymers. Such polymers are described in, for example, U.S. Pat. Nos. 4,346,193, 4,141,847, 4,358,565, 4,409,120 and 4,077,893. All of the above patents relating to polymeric dispersants are utilized for their disclosure of suitable polymeric dispersants which can be utilized in the fuels of this invention.

The Hydrocarbon-Substituted Phenolic Dispersant

The hydrocarbon-substituted phenolic dispersants useful in the fuel compositions of the present invention include the hydrocarbon-substituted phenolic compounds wherein the hydrocarbon substituents have a molecular weight which is sufficient to render the phenolic compound fuel soluble. Generally, the hydrocarbon substituent will be a substantially saturated, hydrocarbon-based group of at least about 30 carbon atoms.

The phenolic compounds may be represented generally by the following formula:

$$(R)_a—Ar—(OH)_b \qquad \text{Formula XV}$$

wherein R is a substantially saturated hydrocarbon-based substituent having an average of from about 30 to about 400 aliphatic carbon atoms, and a and b are each, 1, 2 or 3. Ar is an aromatic moiety such as a benzene nucleus naphthalene nucleus or linked benzene nuclei. Optionally, the above phenates as represented by Formula XV may contain other substituents such as lower alkyl groups, lower alkoxyl, nitro, amino, and halo groups. Preferred examples of optional substituents are the nitro and amino groups.

The substantially saturated hydrocarbon-based group R in Formula XV may contain up to about 750 aliphatic carbon atoms although it usually has a maximum of an average of about 400 carbon atoms. In some instances R has a minimum of about 50 carbon atoms. As noted, the phenolic compounds may contain more than one R group for each aromatic nucleus in the aromatic moiety Ar.

Generally, the hydrocarbon-based groups R are made from homo- or interpolymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. Typically, these olefins are 1-monoolefins. The R groups can also be derived from the halogenated (e.g., chlorinated or brominated) analogs of such homo- or interpolymers. The R groups can, however, be made from other sources, such as monomeric high molecular weight alkenes (e.g. 1-tetracontene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly-(ethylene) greates) and other sources known to those skilled in the art. Any unsaturation in the R groups may be reduced or eliminated by hydrogenation according to procedures known in the art before the nitration step described hereafter.

Specific examples of the substantially saturated hydrocarbon-based R groups are the following:

- a tetracontanyl group
- a henpentacontanyl group
- a mixture of poly(ethylene/propylene) groups of about 35 to about 70 carbon atoms
- a mixture of the oxidatively or mechanically degraded poly-(ethylene/propylene) groups of about 35 to about 70 carbon atoms
- a mixture of poly(propylene/1-hexene) groups of about 80 to about 150 carbon atoms
- a mixture of poly(isobutene) groups having between 20 and 32 carbon atoms
- a mixture of poly(isobutene) groups having an average of 50 to 75 carbon atoms.

A preferred source of the group R are poly-(isobutene)s obtained by polymerization of a $C_4$ refinery stream having a butene content of 35 to 75 weight percent and isobutene content of 30 to 60 weight percent in the presence of a Lewis acid catalyst such as aluminum trichloride or boron trifluoride. These polybutenes contain predominantly (greater than 80% of total repeat units) isobutene repeating units of the configuration.

$-C(CH_3)_2CH_2-$

The attachment of the hydrocarbon-based group R to the aromatic moiety Ar of the amino phenols of this invention can be accomplished by a number of techniques well known to those skilled in the art.

In one preferred embodiment, the phenolic dispersants useful in the fuels of the present invention are hydrocarbon-substituted nitro phenols as represented by Formula XV wherein the optional substituent is one or more nitro groups. The nitro phenols can be conveniently prepared by nitrating appropriate phenols, and typically, the nitro phenols are formed by nitration of alkyl phenols having an alkyl group of at least about 30 and preferably about 50 carbon atoms. The preparation of a number of hydrocarbon-substituted nitro phenols useful in the fuels of the present invention is described in U.S. Pat. No. 4,347,148.

In another preferred embodiment, the hydrocarbon-substituted phenol dispersants useful in the present invention are hydrocarbon-substituted amino phenols such as represented by Formula XV wherein the optional substituent is one or more amino groups. These amino phenols can conveniently be prepared by nitrating an appropriate hydroxy aromatic compound as described above and there after reducing the nitro groups to amino groups. Typically, the useful amino phenols are formed by nitration and reduction of alkyl phenols having an alkyl or alkenyl group of at least about 30 and preferably about 50 carbon atoms. The preparation of a large number of hydrocarbon-substituted amino phenols useful as dispersants in the present invention is described in U.S. Pat. No. 4,320,021.

The Fuel-Soluble Alkoxylated Derivatives of Alcohols, Phenols or Amines

Also useful as dispersants in the fuel compositions of the present invention are fuel-soluble alkoxylated derivatives of alcohols, phenols and amines. A wide variety of such derivatives can be utilized as long as the derivatives are fuel-soluble. More preferably, the derivatives in addition to being fuel-soluble should be water-insoluble. Accordingly, in a preferred embodiment, the fuel-soluble alkoxylated derivatives useful as the dispersants are characterized as having an HLB of from 1 to about 13.

As is well known to those skilled in the art, the fuel-solubility and water-insolubility characteristics of the alkoxylated derivatives can be controlled by selection of the alcohol or phenols and amines, selection of the particular alkoxy reactant, and by selection of the amount of alkoxy reactant which is reacted with the alcohols, phenols and amines. Accordingly, the alcohols which are utilized to prepare the alkoxylated derivatives are hydrocarbon based alcohols which the amines are hydrocarbyl-substituted amines such as, for example, the hydrocarbyl-substituted amines described above as dispersant (B) (i). The phenols may be phenols or hydrocarbon-substituted phenols and the hydrocarbon substituent may contain as few as 1 carbon atom.

The alkoxylated derivatives are obtained by reacting the alcohol, phenol or amine with an epoxide or a mixture of an epoxide and water. For example, the derivative may be prepared by the reaction of the alcohol, phenol or amine with an equal molar amount or an excess of ethylene oxide. Other epoxides which can be reacted with the alcohol, phenol or amine include, for example, propylene oxide, styrene oxide, 1,2-butylene oxide, 2,3-butylene oxide, epichlorohydrin, cyclohexane oxide, 1,2-octylene oxide, etc. Preferably, the epoxides are the alkylene oxides in which the alkylene group has from about 2 to about 8 carbon atoms. As mentioned above, it is desirable and preferred that the amount of alkylene oxide reacted with the alcohol, phenol or amine be insufficient to render the derivative water-soluble.

The following are examples of commercially available alkylene oxide derivatives which may be utilized as dispersants in the fuel compositions of the present invention: Ethomeen S/12, tertiary amine ethylene oxide condensation products of the primary fatty amines (HLB, 4.15; Armak Industries); Plurafac A-24, an oxyethylated straight-chain alcohol available for BASF Wyandotte Industries (HLB 5.00); etc. Other suitable fuel-soluble alkoxylated derivatives of alcohols, phenols and amines will be readily apparent to those skilled in the art.

The following are exemplifications of the use of the present invention.

EXAMPLE I

Adipic acid (438 g.) and Ethomeen TM T/12 (700 g.) a diethoxylated tallow amine are mixed in a 2 liter flask. 30 g. of Amberlyst 15 TM acidic resin is also added as a catalyst for the reaction. The reaction mixture is stirred and heated to 130° C. under nitrogen flow. Water is liberated and collected until the water is completely removed from the reaction product. The reaction is then filtered to give a viscous product with an Mn of 1420. The reaction product is an internal salt.

EXAMPLE II

Century TM PB-82 (a tall oil based polycarboxylic acid containing di and tri acid functionality), at 173 g., and Ethomeen TM 18/60, a stearyl amine ethyoxylated with 50 moles of ethylene oxide are mixed in a 2 liter flask. 30 g. of Amberlyst TM 15 acidic resin is added as catalyst. The stirring reaction is heated to 150° C. while under a nitrogen flow. Water was liberated from the reaction and collected. When all the water had been removed from the product, the reaction is filtered to give a product with an Mn of 8330.

EXAMPLE III

A mixture of 1000 parts of a primary branched sodium monoalkyl benzene sulfonate (M.W. of the acid is 522) in 637 parts of mineral oil is neutralized with 145.7 parts of a 50% caustic solution and the excess water and caustic removed. The product containing the sodium salt obtained in this matter contains 2.5% sodium and 3.7% sulfur.

To 84 parts of the mixture described above are separately added 2.5; 7.5; 12.5 and 25 parts of the product of Example I.

EXAMPLE IV

A neutral sodium salt of a polyisobutylene succinic acid wherein the molecular weight of the anionic portion of the acid is 1,100 is obtained as in U.S. Pat. No. 3,271,310, issued to LeSuer Sept. 6, 1966.

To 200 parts of the sodium salt obtained above are separately added 2.5; 7.5; 12.5 and 25 parts of the reaction product of Example II.

EXAMPLE V

Example III is modified by incorporating 25 or 75 parts of a dispersant which is obtained by treating a mixture of 1500 parts of chlorinated poly-(isobutene) having a molecular weight of about 950 and an chlorine content of 5.6%, 285 parts of an alkylene polyamine having an average composition corresponding to tetraethylene pentamine and 1200 parts of benzene which are heated to reflux. The temperature of the mixture is then slowly increased over a 4 hour period to 170° C. while the benzene is removed. The cooled mixture is diluted with an equal volume of mixed hexanes and absolute ethanol (1:1). The mixture is heated to reflux and ⅓ volume of 10% aqueous sodium carbonate is added to the mixture. After stirring, the mixture is allowed to cool and phase separate. The organic phase is washed with water and stripped to provide the desired polyisobutenyl polyamine having a nitrogen content of 4.5% by weight.

EXAMPLE VI

To 12.5 parts of the reaction product of Example II and 140 parts of the salt of Example IV are added 15 parts of a succinimide dispersant.

Examples III–VI are utilized to form low lead and unleaded gasoline compositions which have substantially reduced tendency to partition or emulsify when mixed with water. The products of the invention also separate rapidly into the desired fuel phase upon standing.

What is claimed is:

1. A composition comprising:

(a) a hydrocarbon soluble or dispersible alkali metal or alkaline earth metal containing composition, and (b) the reaction product of (i) a polybasic acid, and (ii) a polyhydroxyalkanolamine of the formula:

$$RN[(AO)_xH][(DO)_yH]$$

wherein R is a hydrocarbyl radical, A and D are the same or different alkylene groups and x and y are each at least 1.

2. The composition of claim 1 wherein the polybasic acid (b) contains from about 4 to 60 carbon atoms.

3. The composition of claim 1 wherein A and/or D is ethylene.

4. The composition of claim 1 wherein the sum of x+y is from 2 to about 60.

5. The composition of claim 1 wherein R contains from 1 to 20 carbon atoms.

6. The composition of claim 1 wherein the polybasic acid (b) is an alpha-omega dicarboxylic acid.

7. The composition of claim 1 wherein (a) is a sodium salt.

8. The composition of claim 1 wherein (a) is a hydrocarbon soluble or dispersible alkali metal salt derived from a polybasic acid.

9. The composition of claim 1 wherein the polybasic acid (b) is adipic acid.

10. The composition of claim 1 wherein R is from about 12 to about 18 carbon atoms.

11. The composition of claim 1 wherein A is propylene.

12. The composition of claim 1 wherein the polybasic acid is selected from the group consisting of dimer and trimer acids and mixtures thereof.

13. The composition of claim 1 wherein A and/or D is a mixture of ethylene and propylene.

14. The composition of claim 1 wherein the polybasic acid (b) contains from 4 to about 40 carbon atoms.

15. The composition of claim 1 wherein the polybasic acid (b) is a dicarboxylic acid.

16. The composition of claim 1 wherein (a) is an alkyl benzene sulfonate.

17. The composition of claim 1 further including gasoline.

18. The composition of claim 1 additionally containing a hydrocarbon-soluble or hydrocarbon-dispersible ashless dispersant.

19. The composition of claim 1 wherein (a) is a hydrocarbyl substituted succinic acid salt.

20. The composition of claim 1 wherein the polybasic acid (b) is diglycolic acid.

21. A process for reducing valve seat recession in a vehicle requiring such protection comprising introducing to the fuel tank of the vehicle a composition comprising:

(a) a hydrocarbon soluble or dispersible alkali metal or alkaline earth metal containing composition, and (b) the reaction product of (i) a polybasic acid, and (ii) a polyhydroxyalkanolamine of the formula:

$$RN[(AO)_xH][(DO)_yH]$$

wherein R is a hydrocarbyl radical, A and D are the same or different alkylene groups and x and y are each at least 1 wherein the composition is mixed with a fuel and the fuel is combusted.

22. The process of claim 21 wherein the polybasic acid is diglycolic acid.

23. The process of claim 21 wherein the fuel tank contains gasoline and the gasoline is an unleaded gasoline.

24. The process of claim 21 wherein the polybasic acid (b) contains from about 4 to 40 carbon atoms.

25. The process of claim 21 wherein A and/or D is ethylene.

26. The process of claim 21 wherein the sum of x+y is from 2 to about 60.

27. The process of claim 21 wherein R contains from 1 to about 20 carbon atoms.

28. The process of claim 21 wherein R is from about 12 to about 18 carbon atoms.

29. The process of claim 21 wherein the polybasic acid (b) is an alpha-omega dicarboxylic acid.

30. The process of claim 21 wherein the alkali metal salt is the sodium salt.

31. The process of claim 21 wherein the hydrocarbon soluble or dispersible alkali metal salt is derived from a polybasic acid.

32. The process of claim 21 wherein the composition additionally contains a hydrocarbon-soluble or hydrocarbon-dispersible ashless dispersant.

* * * * *